US009631818B2

(12) United States Patent
Powell

(10) Patent No.: US 9,631,818 B2
(45) Date of Patent: Apr. 25, 2017

(54) FIREPLACE GAS INSERT

(71) Applicant: Andrew G. Powell, New Milford, CT (US)

(72) Inventor: Andrew G. Powell, New Milford, CT (US)

( * ) Notice: Subject to any disclaimer, the term of this patent is extended or adjusted under 35 U.S.C. 154(b) by 484 days.

(21) Appl. No.: 14/249,793

(22) Filed: Apr. 10, 2014

(65) Prior Publication Data

US 2015/0292745 A1 Oct. 15, 2015

(51) Int. Cl.
*F24B 1/18* (2006.01)
*F24C 3/00* (2006.01)

(52) U.S. Cl.
CPC ..... *F24C 3/006* (2013.01)

(58) Field of Classification Search
CPC ..... F24C 3/006
(Continued)

(56) References Cited

U.S. PATENT DOCUMENTS 5,052,370 A 10/1991 Karabin
5,341,794 A 8/1994 Henry
(Continued)

FOREIGN PATENT DOCUMENTS

CA 2509718 12/2006

*Primary Examiner* — Avinash Savani
(74) *Attorney, Agent, or Firm* — Michael A. Blake

(57) ABSTRACT

A fireplace gas insert comprising: a fire box; a gas burner tube located inside the fire box; four legs attached to the fire box, and configured to create an air gap below the fire box; a first support bar attached to at least one of the four legs, the support bar extending generally away from the from the fire box; a gas valve attached to the first support bar, and in fluid communication with the gas burner tube; an ignition module attached to the first support bar; a remote control receiver unit attached to the first support bar; a cover configured extend from the left side of a fireplace to the right side of the fireplace, and to extend from the rear of the fireplace to the front of the fireplace, and to present a front face to the room the fireplace is located in, the cover comprising: a top; a front attached to the top and located generally orthogonally to the top; an air draw opening located in the front; a firebox opening located in the top; where the top and front generally encloses and hides from view the first support, gas valve, ignition module, remote control receiver unit, and the convection sleeve, where the firebox opening is in fluid communication with the interior of the firebox; and where the air draw opening is in fluid communication with the firebox opening. A fireplace gas insert system comprising: a fireplace, a fireplace gas insert located in the fireplace, the fireplace gas insert comprising: a fire box; a gas burner tube located inside the fire box; four legs attached to the fire box, and configured to create an air gap below the fire box; a first support bar attached to at least one of the four legs, the support bar extending generally away from the from the fire box; a gas valve attached to the first support bar, and in fluid communication with the gas burner tube; an ignition module attached to the first support bar; a remote control receiver unit attached to the first support bar; a cover configured extend from the left side of the fireplace to the right side of the fireplace, and to extend from the rear of the fireplace to the front of the fireplace, and to present a front face to the room the fireplace is located in, the cover comprising: a top; a front attached to the top and located generally orthogonally to the top; an air draw opening located in the front; a firebox opening located in the top; where the top and front generally encloses and hides from view the first support, gas valve, ignition module, remote control receiver unit, and the convection sleeve, where the firebox opening is in fluid communication with the interior of the firebox; and where the air draw opening is in fluid communication with the firebox opening.

12 Claims, 4 Drawing Sheets

(58) Field of Classification Search
USPC ..... 126/512, 523
See application file for complete search history.

(56) References Cited

U.S. PATENT DOCUMENTS

| | | | | |
|---|---|---|---|---|
| 5,503,550 | A | 4/1996 | DePalma | |
| 5,865,165 | A | 2/1999 | Brazier | |
| 6,029,655 | A | 2/2000 | Hussong | |
| 6,116,232 | A | 9/2000 | Valters | |
| 6,261,087 | B1 * | 7/2001 | Bird | F23N 5/102 126/512 |
| 8,166,965 | B2 | 5/2012 | Miles | |
| 8,528,540 | B2 | 9/2013 | Marple | |
| 8,602,020 | B2 | 12/2013 | Marple | |
| 2006/0283442 | A1 * | 12/2006 | Miles | F24C 3/002 126/523 |

* cited by examiner

Burner with Labels 2

Cover 7 air flow section

System installed 4

FIREPLACE GAS INSERT

TECHNICAL FIELD

The invention relates to a gas insert for a fireplace, and, more particularly, to a gas insert with improved heat dissipation.

BACKGROUND

When converting a fireplace to a gas fireplace, the main style of gas insert is the gas log set. If a consumer is looking for a contemporary alternative to a gas log set, the choices are not very attractive. The known choices are freestanding burners, a pile of crushed glass covering a burner, or an entirely enclosed firebox insert, each of which detracts from the charm and aesthetic quality of the fireplace.

One option is installing a freestanding burner with an after-market cover. This option has met with mixed results. The lack of ventilating air being drawn into the covered volume often causes heat build-up issues. This heat build-up is not surprising because freestanding burners are not designed to be covered or enclosed. The heat will build-up because air is not kept moving around the insert or hot air is drawn down from around the flame.

Thus there is a need for a fireplace gas insert that overcomes the above listed and other disadvantages.

SUMMARY OF THE INVENTION

The disclosed invention relates to a fireplace gas insert comprising: a fire box; a gas burner tube located inside the fire box; four legs attached to the fire box, and configured to create an air gap below the fire box; a first support bar attached to at least one of the four legs, the support bar extending generally away from the from the fire box; a gas valve attached to the first support bar, and in fluid communication with the gas burner tube; an ignition module attached to the first support bar; a remote control receiver unit attached to the first support bar; a cover configured extend from the left side of a fireplace to the right side of the fireplace, and to extend from the rear of the fireplace to the front of the fireplace, and to present a front face to the room the fireplace is located in, the cover comprising: a top; a front attached to the top and located generally orthogonally to the top; an air draw opening located in the front; a firebox opening located in the top; where the top and front generally encloses and hides from view the first support, gas valve, ignition module, remote control receiver unit, and the convection sleeve, where the firebox opening is in fluid communication with the interior of the firebox; and where the air draw opening is in fluid communication with the firebox opening.

The invention also relates to a fireplace gas insert system comprising: a fireplace, a fireplace gas insert located in the fireplace, the fireplace gas insert comprising: a fire box; a gas burner tube located inside the fire box; four legs attached to the fire box, and configured to create an air gap below the fire box; a first support bar attached to at least one of the four legs, the support bar extending generally away from the from the fire box; a gas valve attached to the first support bar, and in fluid communication with the gas burner tube; an ignition module attached to the first support bar; a remote control receiver unit attached to the first support bar; a cover configured extend from the left side of the fireplace to the right side of the fireplace, and to extend from the rear of the fireplace to the front of the fireplace, and to present a front face to the room the fireplace is located in, the cover comprising: a top; a front attached to the top and located generally orthogonally to the top; an air draw opening located in the front; a firebox opening located in the top; where the top and front generally encloses and hides from view the first support, gas valve, ignition module, remote control receiver unit, and the convection sleeve, where the firebox opening is in fluid communication with the interior of the firebox; and where the air draw opening is in fluid communication with the firebox opening.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

This product incorporates a design which uses the heat, generated by the gas flame, as an engine to circulate air through a confined space keeping the components and burner tray cool. This invention converts a solid fuel burning fireplace into a convenient, clean, contemporary gas flame fireplace, with only visually obstructing the bottom 6 inches of the fireplace's hearth (sometimes known as the firebox). The installation is as easy as putting in a gas log set; all that is needed is a gas line and an electrical outlet. The cover and burner work in unison to remove heat efficiently from the burner's components. The heat generated by the burner is used to generate air flow, which draws in room air while exhausting the hottest air into the chimney.

A convection sleeve is mounted around all sides of burner tray. The heat radiated from the sides of the burner tray goes into an air gap in the sleeve, heating the air in the air gap, and forcing it to go upward, producing a measurable negative pressure under the cover. The opening in the front of the cover draws ambient room air inward cooling the compartment and the components. The burner tray is also kept cooler by the velocity of the air drawn up its sides, removing heat faster. This gas flame system has been designed from top to bottom to deal with the problem of accumulated heat caused by being installed in an enclosed space. Starting with the convection sleeve which generates a positive flow of air as well as buffers the components from the most extreme firebox heat, and the low front air inlet which intakes the coolest air available, as well as the outrigger style component mounting bar which allows the inbound ventilation air to engulf the components.

The system is comprised of three main parts, a low profile media burner, a custom fit cover, and a remote control. When installed this flame system occupies the bottom about six inches of the fireplace's firebox, and all mechanicals and components are concealed by the cover. The low profile media burner is based around a media burner firebox which is comprised of four sides and a floor that is elevated 2 inches from the bottom. The four sides of the firebox extend down and become legs with spaces in between to allow for air flow. Firebox stands six inches tall, and is constructed of any suitable material, such as but not limited to fourteen gauge steel, or thicker.

The invention is generally a low profile gas appliance incorporating a cover that is custom fit to the firebox creating an air plenum to guide air through in order to ventilate components.

Figure 1:
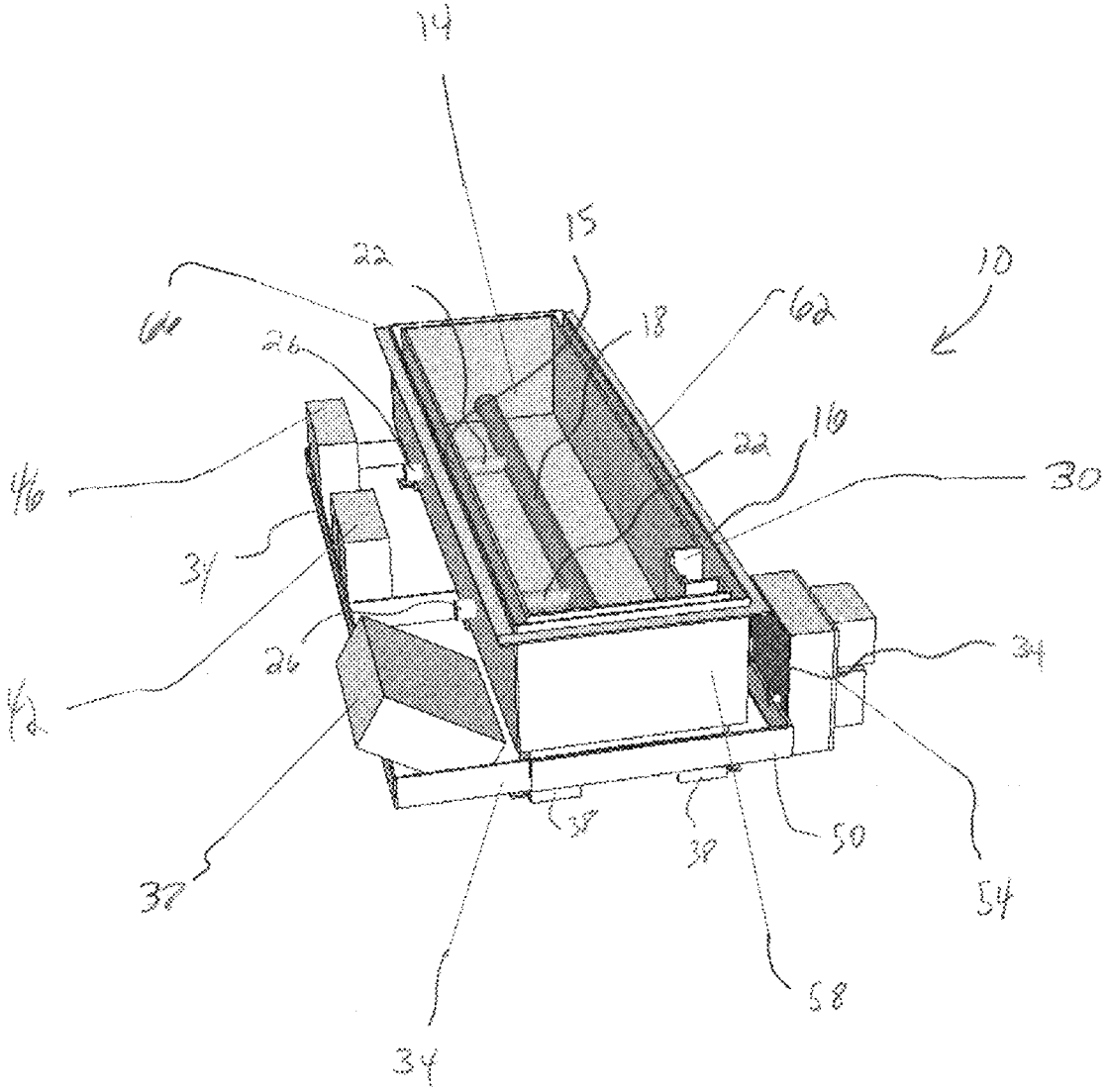
FIG. 1 is a perspective view of the fireplace gas insert without the cover.

FIG. 1 shows a side perspective view of the fireplace gas insert 10. The insert comprises a firebox 14. Inside the firebox 14 a gas burner tube 18 runs down generally the center length of the firebox 14. The gas burner tube 18 may be bottom ported, and may be elevated off the floor of the firebox 14. The burner tube 18 may have one manifold supply tube 22 for every twelve inches of burner. Each manifold supply tube 22 may be installed with a gas orifice 26 located outside the firebox. The gas orifice 26 may be connected to flexible gas line (not shown) that is in communication with a gas supply (not shown). Each flexible gas line may continue to a gas line splitter (a simple tee for a two line system), and then may continue to the discharge side of the gas valve. A pilot assembly 30 is mounted to the back of the firebox about an inch from the right side of the firebox 14. The pilot assembly 30 comprises a pilot light and a flame sensor. The insert may comprise a first 'outrigger' style support bar 34. In this document, outrigger means a support bar that can hold components away from the firebox. The support bar 34 may be attached to four firebox legs 38 (only two are visible in this view), and will extend out, across the front 15, and then back 16 of the firebox 14. The support bar 34 will be the attachment point for the gas valve 38, ignition module 42, and remote control receiver unit 46. A second 'outrigger' style support bar 50 will extend from the back 16 of firebox for attachment of an optional transformer/relay device 54. The transformer/relay device may be in signal communication with the ignition module 42 and the remote control receiver unit 46. The insert 10 may also comprise a convection sleeve 58 that may be about four inches tall, and wraps around all four sides of firebox 14. The convection sleeve 58 will maintain a constant gap 62 around firebox of about one quarter inch, however a larger or smaller gap may be used depending on the heat dissipation of the invention. At the top of the convection sleeve is a horizontal flange 66 which will mate with top opening in the cover 70 (not shown in this Figure). The support bars 34, 50 are configured to hold the insert components (gas valve 38, ignition module 42, and remote control receiver unit 46, and transformer/relay device 54) away from the heat of the fire box 14 and allow room for air flow between the fire box 14 and the components, to keep those components relatively cool. In one embodiment, the first support bar is about 5" from the firebox, and second support bar is about 1" to about 2" from the firebox.

Figure 2:
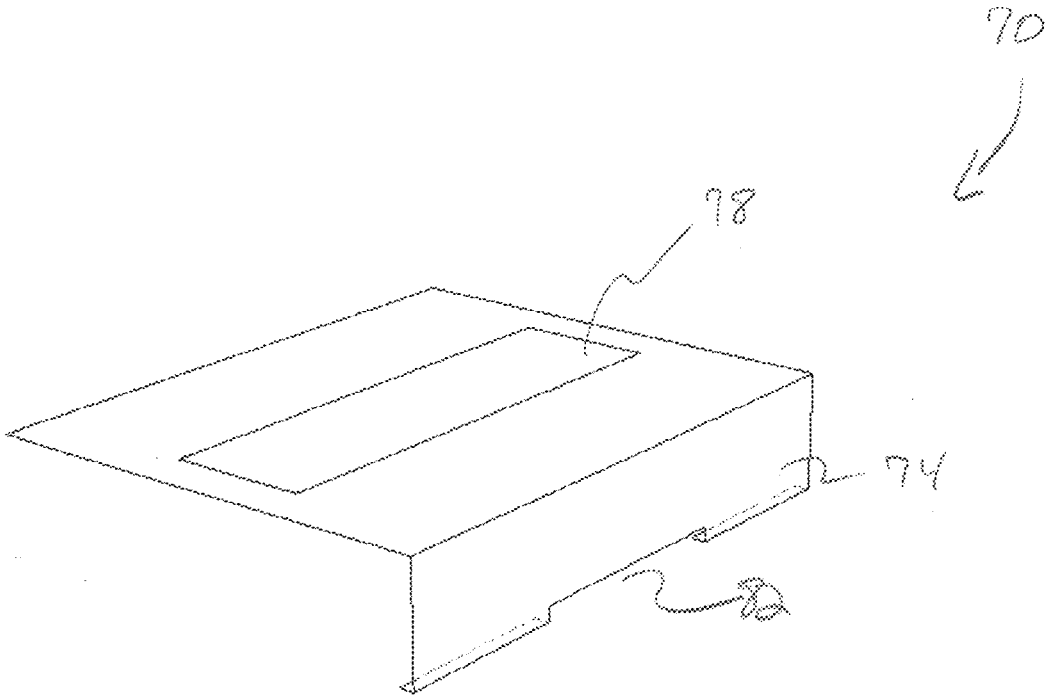
FIG. 2 is a perspective view of the cover.

FIG. 2 shows the cover 70. The front 74 of the cover 70 is shown, as well as the firebox opening 78. The flanges 66 will abut the cover 70 adjacent to the firebox opening 78. One can see that the firebox opening is generally the same size and shape as the interior perimeter of the firebox 14. The front 74 has air draw opening 82 located, in one embodiment, near the bottom of the front 74 and may be about a 6" horizontal opening. The cover 70 may be made out of any suitable material including steel, or other materials with proper heat resistance. The firebox opening 78 may be configured to mate with the flange 66 of the convection sleeve 58.

Figure 3:
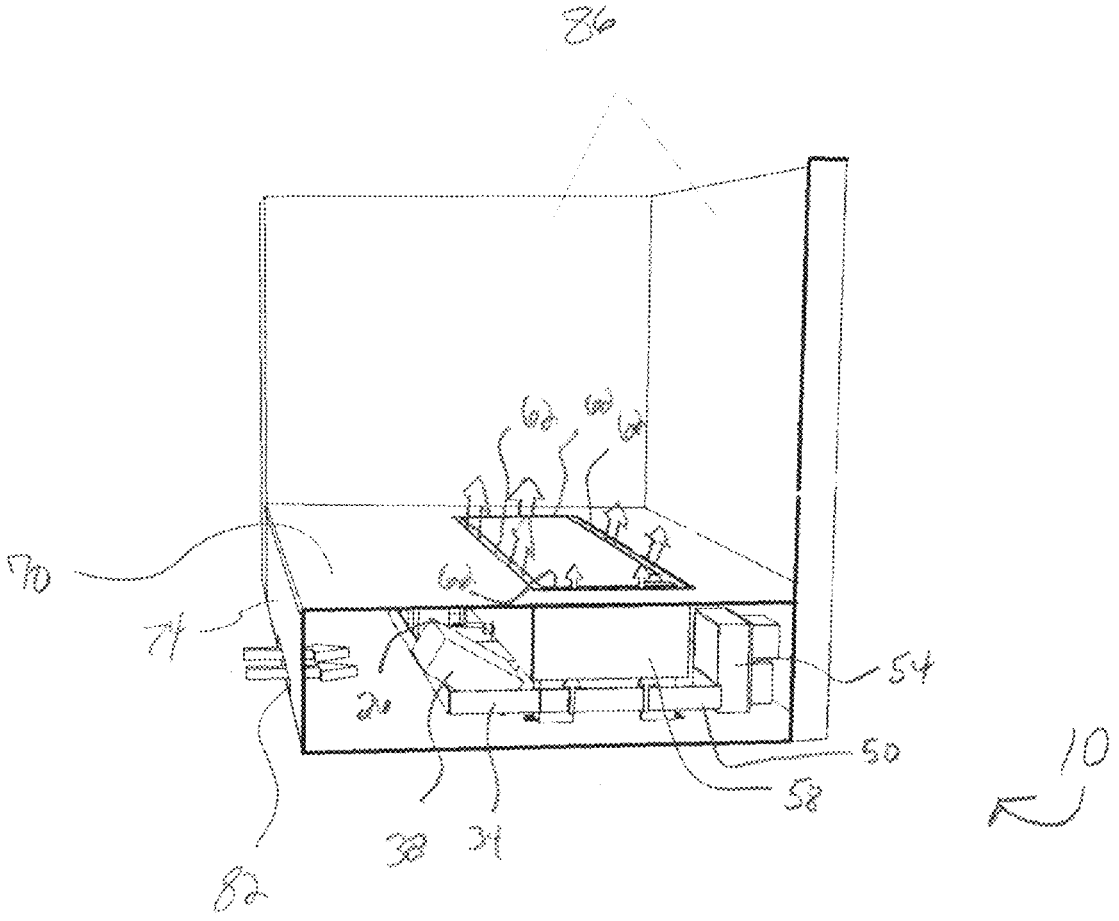
FIG. 3 is a side perspective view of the fireplace gas insert, showing the air flow.

FIG. 3 is a side perspective view of the fireplace gas insert 10 with the cover 70 installed. The arrows represent the air flow through the fireplace and gas insert 10. Cool ambient air flows from the room where the fireplace 86 is located and into the air draw opening 82. The cool air generally surrounds the firebox in the air gap 62 where it is heated by the firebox, and rises up as shown by the vertical arrows, and goes up the chimney. This air flow prevents from heat from accumulating in the fireplace gas insert 10, and prevents damage, and unexpected fire hazards.

Figure 4:
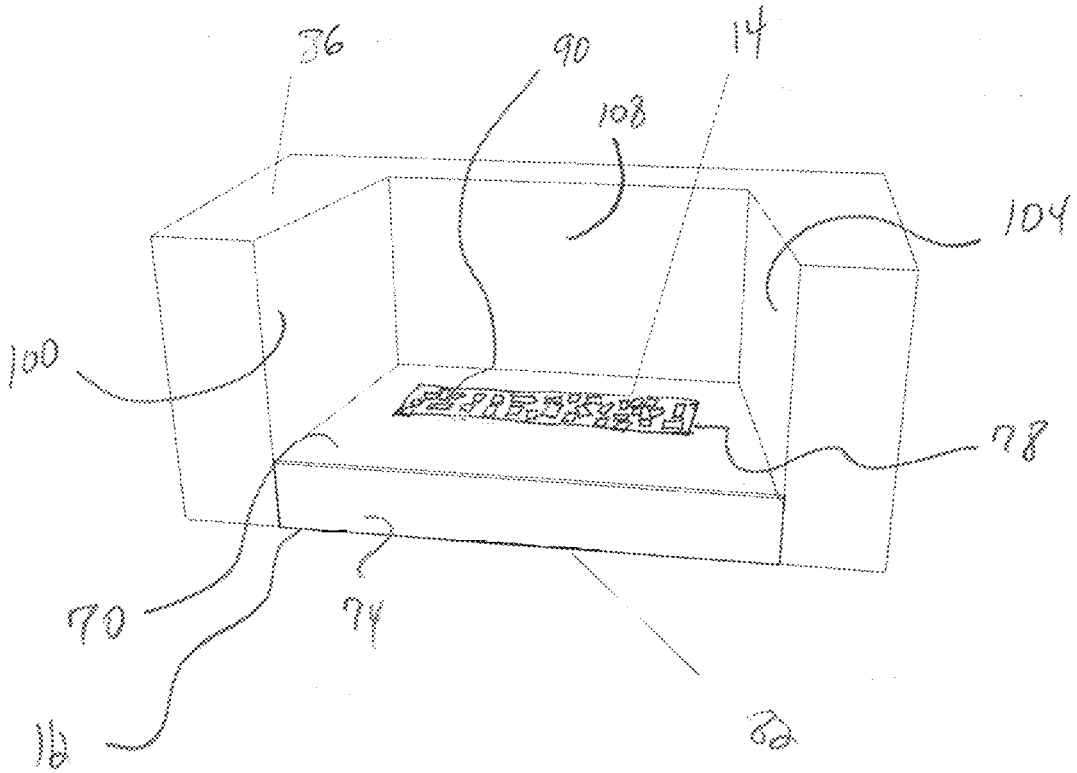
FIG. 4 is a front perspective view of the fireplace gas insert installed in a fireplace.

FIG. 4 shows one embodiment of the fireplace gas insert 10 installed in a fireplace 86 (shown partially cutaway). Located in the firebox may also be decorative media 90, such as cut fire glass, crushed fire glass, shaped fire glass, colored fire glass, lava stones, fiber rocks, fire beads etc. One can see that the fireplace gas insert 10 has a nice aesthetic look because the gas burner(s), hoses, connectors, gas lines, etc. are not visible. The cover generally covers the components and hoses, leaving generally only the media is visible, with flames emanating from the media when the gas flame is burning. The aesthetic look comes about because the cover 70 covers generally all the components that make up the fireplace gas insert 10, except for the that which can be seen through the firebox opening 78—namely the media 90 and any flames that come up out of the media (due to the gas from the gas burner burning). Thus note that cover 78 extends from the left side of the fireplace 100 to the right side of the fireplace 104, and extends from the rear of the fireplace 108 to the front 112 of the fireplace, and to present a front face 74 to the room the fireplace is located in.

The fireplace gas insert 10 may be installed in the following way; however one of ordinary of skill will recognize that the fireplace gas insert 10 may be installed in numerous ways. The flame system is installed by first providing a gas line and 110 volt outlet in the bottom of the fireplace. A low profile media burner is then secured to the floor of the fireplace's hearth by two masonry screws. The cover is supported at fireplace's hearth's walls with standard hardware such as 'L-bracket' or angle iron, which is attached with masonry screws. The firebox of the insert may be filled with media. The gas line is connected to the gas valve, and the electronic ignition is plugged into 110 volt outlet, then the cover is set on top of the burner flange and the wall brackets, the front of the cover rests on the hearth. Once installed, the remote control will be used to turn the flame on and off.

This invention has many advantages. The fireplace gas insert provides an aesthetically pleasing insert where gas lines, burners, connectors, etc. are not visible. Further, the fireplace gas insert is designed to provide air flow around the fire box to prevent overheating and damage to the components and/or unexpected fire hazards. The current invention achieves the aesthetic look without requiring additional ventilation (other than the ventilation already designed into the system). The current invention does not require an after-market cover to be built, only to find that the after-market cover does not properly fit or work. The cover remains under 500° F. due to the air flow, and thus a greater variety of colors may be used for the cover.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A fireplace gas insert comprising:

a fire box;

a gas burner tube located inside the fire box;

four legs attached to the fire box, and configured to create an air gap below the fire box;

a first support bar attached to at least one of the four legs, the support bar extending generally away from the fire box;

a gas valve attached to the first support bar, and in fluid communication with the gas burner tube;

an ignition module attached to the first support bar;

a remote control receiver unit attached to the first support bar;

a cover configured to extend from the left side of a fireplace to the right side of the fireplace, and to extend from the rear of the fireplace to the front of the fireplace, and to present a front face to the room the fireplace is located in, the cover comprising:

a top;

a front attached to the top and located generally orthogonally to the top;

an air draw opening located in the front;

a firebox opening located in the top;

a convection sleeve wrapped around all four sides of the fire box, with an air gap between the convection sleeve and all four sides of the fire box, the air gap in fluid communication with the air draw opening and the firebox opening wherein the top and front generally encloses and hides from view the first support, gas valve, ignition module, remote control receiver unit, and the convection sleeve, wherein the firebox opening is in fluid communication with the interior of the firebox; and wherein the air draw opening is in fluid communication with the firebox opening.

2. The fireplace gas insert of claim 1, wherein the air gap is about ¼ inch between the convection sleeve and any of the four sides of the fire box.

3. The fireplace gas insert of claim 1, further comprising:

a second support bar attached to at least one of the four legs, the support bar extending generally away from the from the fire box, and on a side of the firebox opposite the first support bar;

a transformer/relay device attached to the second support bar, the transformer/relay device in signal communication with the ignition module and the remote control receiver unit.

4. The fireplace gas insert of claim 1, further comprising:

decorative media located in the firebox.

5. The fireplace gas insert of claim 1, wherein the air draw opening is generally a horizontal opening about 6 inches wide near the bottom of the front of the cover.

6. The fireplace gas insert of claim 1, wherein the firebox opening is generally the same size and shape as the interior perimeter of the firebox.

7. A fireplace gas insert system comprising:

a fireplace, a fireplace gas insert located in the fireplace, the fireplace gas insert comprising:

a fire box;

a gas burner tube located inside the fire box;

four legs attached to the fire box, and configured to create an air gap below the fire box;

a first support bar attached to at least one of the four legs, the support bar extending generally away from the fire box;

a gas valve attached to the first support bar, and in fluid communication with the gas burner tube;

an ignition module attached to the first support bar;

a remote control receiver unit attached to the first support bar;

a cover configured extend from the left side of the fireplace to the right side of the fireplace, and to extend from the rear of the fireplace to the front of the fireplace, and to present a front face to the room the fireplace is located in, the cover comprising:

a top;

a front attached to the top and located generally orthogonally to the top;

an air draw opening located in the front;

a firebox opening located in the top;

a convection sleeve wrapped around all four sides of the fire box, with an air gap between the convection sleeve and all four sides of the fire box, the air gap in fluid communication with the air draw opening and the firebox opening wherein the top and front generally encloses and hides from view the first support, gas valve, ignition module, remote control receiver unit, and the convection sleeve, wherein the firebox opening is in fluid communication with the interior of the firebox; and wherein the air draw opening is in fluid communication with the firebox opening.

8. The fireplace gas insert system of claim 7, wherein the air gap is about ¼ inch between the convection sleeve and any of the four sides of the fire box.

9. The fireplace gas insert system of claim 7, further comprising:

a second support bar attached to at least one of the four legs, the support bar extending generally away from the from the fire box, and on a side of the firebox opposite the first support bar;

a transformer/relay device attached to the second support bar, the transformer/relay device in signal communication with the ignition module and the remote control receiver unit.

10. The fireplace gas insert system of claim 7, further comprising:

decorative media located in the firebox.

11. The fireplace gas insert system of claim 7, wherein the air draw opening is generally a horizontal opening about 6 inches wide near the bottom of the front of the cover.

12. The fireplace gas insert system of claim 7, wherein the firebox opening is generally the same size and shape as the interior perimeter of the firebox.

* * * * *